United States Patent [19]

Earl

[11] Patent Number: 4,470,547

[45] Date of Patent: Sep. 11, 1984

[54] VARIABLE OUTPUT NOZZLE

[75] Inventor: Webster B. Earl, Lewisville, N.C.

[73] Assignee: Fairchild Industries, Inc., Germantown, Md.

[21] Appl. No.: 362,472

[22] Filed: Mar. 26, 1982

[51] Int. Cl.[3] ..... B05B 1/30

[52] U.S. Cl. ..... 239/533.1; 239/563; 239/568; 137/82

[58] Field of Search ..... 239/562, 563, 533.1, 239/568, 541, 598, 454, 381, 382; 73/37.5; 137/533.11, 533.15, 539, 872, 82

[56] References Cited

U.S. PATENT DOCUMENTS

| | | | |
|---|---|---|---|
| 1,515,664 | 11/1924 | Dunkelberger | 239/381 |
| 1,874,283 | 8/1932 | Goldberg | 239/563 X |
| 3,477,648 | 11/1969 | Roosa | 239/563 X |
| 3,552,188 | 1/1971 | Rolland | 73/37.5 |
| 3,606,169 | 9/1971 | West | 239/568 X |

FOREIGN PATENT DOCUMENTS

| | | | |
|---|---|---|---|
| 853597 | 11/1960 | United Kingdom | 239/541 |

*Primary Examiner*—Andres Kashnikow
*Assistant Examiner*—Mary F. McCarthy
*Attorney, Agent, or Firm*—Michael W. York

[57] ABSTRACT

A variable output nozzle for permitting the output of air or gas from the nozzle to be varied. The variable output nozzle includes a nozzle housing having a bore located therein, a spherical ball located within the bore for reciprocal movement within the bore and an aperture in the nozzle housing for supplying pressurized air or gas to the bore in the nozzle housing. A plurality of slots are also located in the nozzle housing and extend into the upper portion of the bore and the bottoms of at least some of these slots are located at different depths so that the volume of pressurized air or gas exiting the nozzle will vary as the spherical ball passes the bottoms of the slots. The variable output nozzle is particularly useful as a pneumatic pressure transducer nozzle.

15 Claims, 4 Drawing Figures

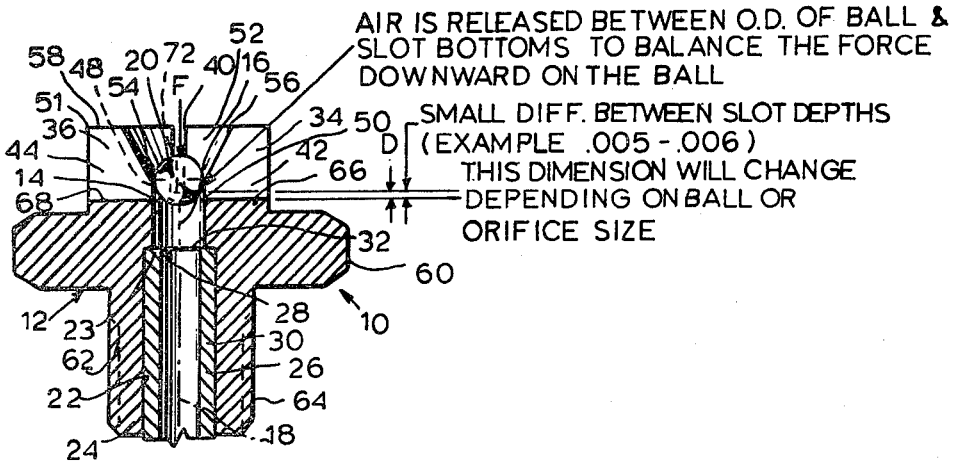

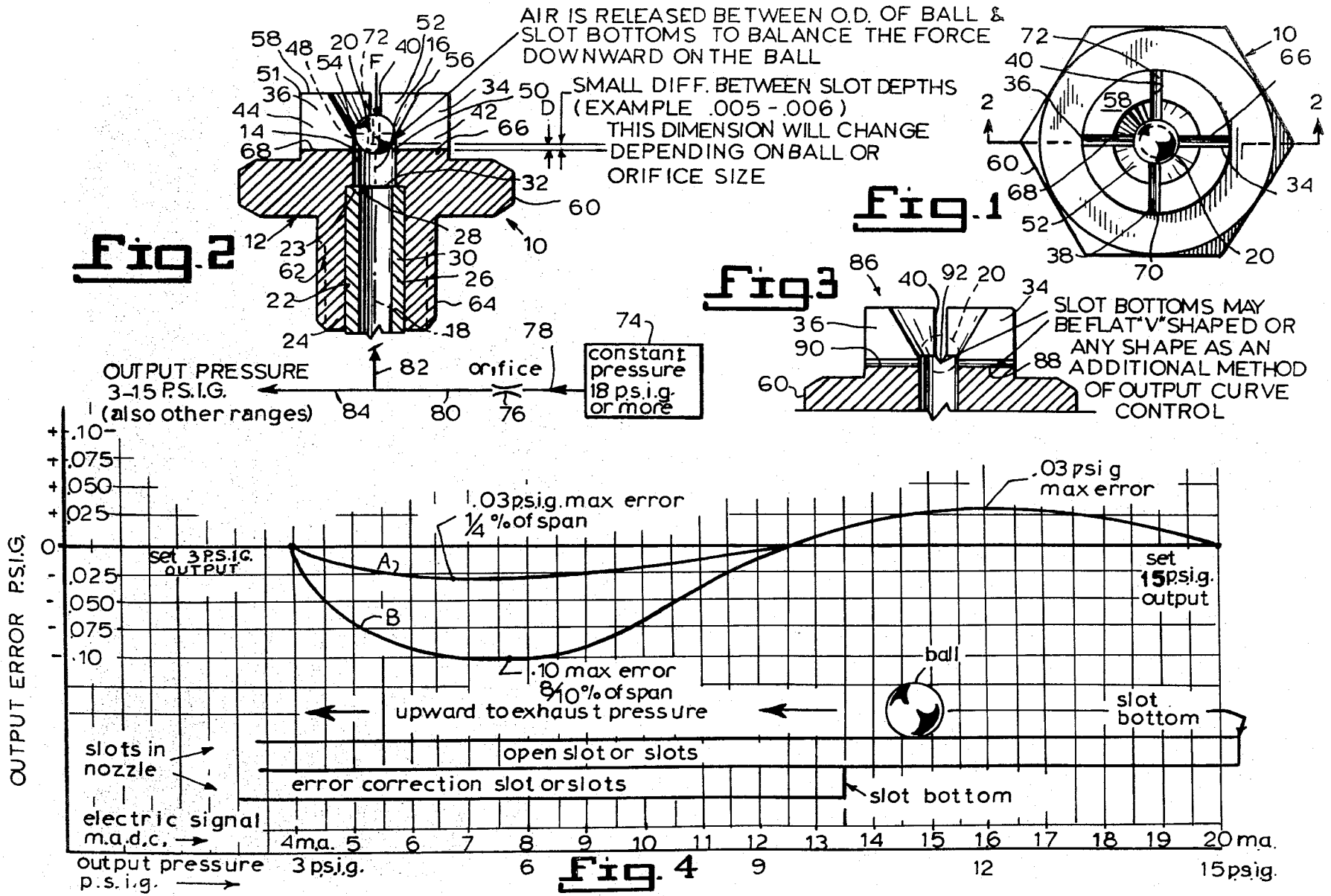
AIR IS RELEASED BETWEEN O.D. OF BALL & SLOT BOTTOMS TO BALANCE THE FORCE DOWNWARD ON THE BALL
SMALL DIFF. BETWEEN SLOT DEPTHS (EXAMPLE .005 - .006) THIS DIMENSION WILL CHANGE DEPENDING ON BALL OR ORIFICE SIZE
SLOT BOTTOMS MAY BE FLAT "V" SHAPED OR ANY SHAPE AS AN ADDITIONAL METHOD OF OUTPUT CURVE CONTROL
constant pressure 18 p.s.i.g. or more
orifice
OUTPUT PRESSURE 3-15 P.S.I.G. (also other ranges)
.03 psi g max error
set 15 psi.g. output
slot bottom
ball
.03 psi.g. max error
1/4 % of span
.10 max error 8/10% of span
upward to exhaust pressure
open slot or slots
error correction slot or slots
set 3 P.S.I.G. OUTPUT
slots in nozzle
electric signal m.a.d.c.
output pressure p.s.i.g.
OUTPUT ERROR P.S.I.G.
Fig. 1
Fig. 2
Fig. 3
Fig. 4

VARIABLE OUTPUT NOZZLE

BACKGROUND OF THE INVENTION

In many cases it is extremely important to have a nozzle whose fluid output is variable. For instance this is very important in nozzles used in force to pressure transducers. In such pressure transducers it is very important for accuracy that the transducer gives a true linear pressure output in reference to a force input.

Most force to pressure transducers, such as electric to pneumatic transducers, use a nozzle which has a flopper or a ball seated in the nozzle. Unfortunately both of these types of nozzles due to flow factors do not give a true linear pressure output in reference to a force input.

The variable output nozzle of this invention overcomes these problems and allows the output error to be corrected to improve the linearity and performance of force to pressure transducers. With this invention the force to pressure transducer gives a more accurate output pressure representation of the force input. In addition the variable output nozzle of the invention is highly reliable, does not require complex moving parts and is easy and inexpensive to manufacture.

BRIEF DESCRIPTION OF THE INVENTION

This invention relates to nozzles and more particularly to nozzles whose output is variable.

Accordingly, it is an object of the present invention to provide a variable output nozzle whose output is variable in a predetermined manner.

It is also an object of the present invention to provide a variable output nozzle which is highly reliable.

It is also an object of the present invention to provide a variable output nozzle which does not require complex moving parts.

It is an object of the present invention to provide a variable output nozzle which is easy to manufacture.

It is an object of the present invention to provide a variable output nozzle which is inexpensive to manufacture.

It is also an object of the present invention to provide a variable output nozzle whose output automatically varies as a force input is varied.

It is an object of the present invention to provide a variable output nozzle which can give a linear output.

It is an object of the present invention to provide a variable output nozzle which can give an accurate output in response to a force input.

It is also an object of the present invention to provide a variable output nozzle which is readily usable in a transducer as a transducer nozzle.

It is also an object of the present invention to provide a variable output nozzle which is readily usable in a force to pressure transducer.

It is also an object of the present invention to provide a variable output nozzle which can be used in a force to pressure transducer to enhance the performance of the transducer.

It is also an object of the present invention to provide a variable output nozzle which can be used in a force to pressure transducer to increase the accuracy of the transducer.

It is also an object of the present invention to provide a variable output nozzle which can be used in a force to pressure transducer to correct output errors.

It is also an object of the present invention to provide a variable output nozzle which can be used in a force to pressure transducer to provide a more linear pressure output in reference to a force input.

It is also an object of the present invention to provide a variable output nozzle which can be used in an electric to pneumatic transducer as the transducer nozzle.

The present invention provides a variable output nozzle including a nozzle housing having a bore located therein, reciprocating means located within the bore of the nozzle housing for reciprocal movement within the bore and means connected to the bore of the nozzle housing for supplying fluid pressure to the bore of the nozzle housing. Fluid releasing means is also provided for releasing fluid from the bore of the nozzle housing when the reciprocating means is located at predetermined locations within the bore of the nozzle housing.

BRIEF DESCRIPTION OF THE DRAWINGS

The invention will be hereinafter more fully described with reference to the accompanying drawings in which:

FIG. 1 is a top plan view of the variable output nozzle of the present invention;

FIG. 2 is cross sectional view of the variable output nozzle illustrated in FIG. 1 taken on the line 2—2 thereof also showing a schematic representation of how the variable output nozzle could be connected;

FIG. 3 is a cross sectional view of a portion of the variable output nozzle similar to a portion of the structure illustrated in FIG. 2, but illustrating an additional embodiment of the invention; and FIG. 4 is a graph showing the pressure output error versus output pressure from the nozzle of the present invention.

DETAILED DESCRIPTION OF THE PREFERRED EMBODIMENTS

The variable output nozzle of the invention is illustrated in FIGS. 1 and 2 and is designated generally by the number 10. The variable output nozzle 10 comprises a nozzle housing 12 which has a cylindrical circular cross sectional bore 14 centrally located within the nozzle housing with the long axis 16 of the bore 14 generally coinciding with the long axis 18 of the nozzle 10. The variable output nozzle 10 also comprises reciprocating means located within the bore 14 which comprises a spherical or substantially spherically-shaped ball 20 which has a sufficient diameter so that it substantially fills the cross sectional area of the bore 14 but is free to move up and downward in a reciprocating manner within the bore 14.

The variable output nozzle 10 also comprises means connected to the bore 14 of the nozzle housing 12 for supplying fluid pressure to the bore 14 which includes a hole 22 whose upper end 23 terminates adjacent to the lower opening of the bore 14 and whose lower end extends to the outside lower portion 24 of the housing 12. The diameter of this hole 22 is larger than the diameter of the bore. This hole 22 is adapted to receive a portion of a hollow cylindrical conduit 26 which should be of sufficient diameter to be pressed into place or glued into place within the hole 22 with its upper end portion 28 abutting up against the upper end 23 of the hole 22. It should be noted that the wall 30 of the conduit 26 is sufficiently thick so that part of the upper end portion 28 extends into and blocks a portion of the lower end portion 32 of the bore 14 and consequently the upper end portion 28 of the conduit prevents the spherical ball 20 from passing out of the lower end portion 32 of the bore 14.

The variable output nozzle 10 also comprises fluid releasing means for releasing fluid from the bore 14 of the nozzle housing 12 when the spherical ball 20 is located at predetermined locations within the bore 14 of the nozzle housing 12 which comprise the slots 34 and 36 and 38 and 40 whose respective lower portions 42 and 44 and 46 and 48 extend through the nozzle housing 12 and into the upper portion 50 of the bore 14. The upper portion 51 of the nozzle housing 12 which contains the slots 34 and 36 and 38 and 40 is substantially cylindrical shaped and has a funnel shaped flared opening 52 located substantially in its center. The lower portion 54 of the funnel shaped flared opening 52 is connected to the upper portion 50 of the bore 14 and the larger upper portion 56 of the flared opening 52 extends to the upper surface 58 of the upper portion 51 of the nozzle housing 12.

The central portion 60 of the nozzle housing 12 is located immediately below the upper portion 51 and as best illustrated in FIG. 1 has a hexagonal shaped outer exterior to permit the nozzle housing 12 to be suitably rotated through the use of a wrench in a manner well known in the art. The lower portion 62 of the nozzle housing 12 is located just below the central portion 60 and it is generally cylindrical shaped with threads 64 located on a portion of its exterior surface. These threads 64 are adapted to be screwed into a suitable threaded aperture (not shown) known in the art when the variable output nozzle 10 is put into use.

As indicated in FIGS. 1 and 2 the slots 34 and 36 and 38 and 40 are located in such a manner that the respective lower portions 42 and 44 and 46 and 48 which extend into the upper portion 50 of the bore 14 result in elongated apertures in the upper portion of the bore 14 whose elongated portions or longitudinal axes are substantially parallel to the path of travel of the reciprocating ball 20. It will also be noted that the slot 34 is located in the upper portion 51 of the nozzle housing 12 substantially directly opposite the bore 14 from the slot 36 and that the slot 38 is substantially directly opposite the bore 14 from the slot 40.

It is very important to note, as best illustrated in FIG. 2, that the bottoms 66 and 68 of the respective slots 34 and 36 are located a distance D below the bottoms 70 and 72 of the respective slots 38 and 40. This distance D is between the slot bottoms and is very important. In the preferred embodiment this distance D would be about 0.001 of an inch to about 0.030 of an inch for using the variable output nozzle 10 in common electric to pneumatic transducers. In particular, it was found that the distance D of about 0.005 to about 0.006 worked very satisfactory for one type of variable output nozzle 10. However, the selection of a particular dimension for D will depend upon the size of the bore 14, the pneumatic force involved and the width of the slots as well as other factors known to those skilled in the art.

In view of the slots 34 and 36 and 38 and 40 and the respective bottoms 66 and 68 and 70 and 72 when the variable output nozzle 10 is in use as the spherical ball 20 moves upward air or a gas will first exit the upper portion 50 of the bore 14 by passing into the lower portions 42 and 44 of the respective slots 34 and 36 when the central portion of the ball 20 just passes the bottoms 66 and 68 of the respective slots 34 and 36. As the spherical ball 20 continues to move upward air or a gas will also exit the upper portion 50 of the bore 14 by passing into the lower portions 46 and 48 of the respective slots 38 and 40 when the central portion of the spherical ball 20 just passes the bottoms 70 and 72 of the respective slots 38 and 40. It will be noted, as illustrated in FIG. 2, that upward movement of the spherical ball 20 is opposed by a downward force represented by the arrow and the letter F. In practice this force would be transmitted through a plunger (not shown) which would be part of the surrounding pressure transducer apparatus (not shown) or in some cases the force F could merely represent the weight of the spherical ball 20.

FIG. 2 also illustrates the manner in which the variable output nozzle 10 would be connected in a force to pressure transducer system. As illustrated in FIG. 2 a source of constant air or gas pressure 74 is provided for the pressure transducer system and the pressure in the source of air or gas pressure 74 should be 18 P.S.I.G. or more. Air or a gas is fed from the source 74 to an orifice 76 via a conduit represented by the number 78. From the orifice 76 the air or a gas then passes through a conduit represented by the number 80 and then a portion of the air or a gas is diverted to the variable output nozzle 10 via a conduit represented by the number 82 where it enters the bore 14 via the conduit 26. The other portion of the air or gas in the conduit 80 is diverted to the output conduit represented by the number 84. The pressure at the end of the output conduit 84 will vary depending upon the location of the spherical ball 20 which will in turn depend upon the magnitude of the force F.

FIG. 3 illustrates an alternative embodiment of the variable output nozzle which is designated generally by the number 86. The variable output nozzle 86 is identical to the variable output nozzle 10 illustrated in FIGS. 1 and 2 except that the bottoms, as illustrated by the bottoms 88, 90, and 92 of the respective slots 34, 36 and 38 are not substantially flat as are the bottoms 66, 68, 70 and 72 illustrated in FIGS. 1 and 2. Instead, these bottoms 88, 90 and 92 are tapered inwardly and downwardly to substantially form a V and these bottoms 88, and 90 provide an additional means of varying the output of the variable output nozzle 86 depending upon the location of the spherical ball 20.

FIG. 4 is a graph of a typical error curve for an electric to pneumatic transducer both with and without the variable output nozzle 10. In viewing the graph it should be realized that the force F is varied as a result of the milliampere electrical signal on the X-axis of the graph. The Y-axis on the graph indicates the output error in P.S.I.G. or pounds per square inch gauge. The location of the slot or slots and their bottoms are illustrated above the electrical and output pressure reading on the X-axis of the graph. The system represented by the graph was set for 0 error at its 15 P.S.I.G. maximum reading which corresponds to a 20 milliampere DC input and for a 0 error at its lower limit of 3 P.S.I.G. which corresponds to 4 milliamperes. Curve B illustrates the error with a nozzle which has one slot or more slots whose depth is substantially identical or a case where the nozzle had no slots. As illustrated by the curve B, as the ball 20 moves upward a significant error of some 0.10 P.S.I.G. results. However, as illustrated by curve A this error is reduced to some 0.03 P.S.I.G. with the variable output nozzle 10 with the differences D in the depths of the bottoms of the slots. This significant reduction in error is extremely important in force to pressure transducers such as electric to pneumatic transducers where accuracy is of prime importance.

The variable output nozzle 10 or 86 is made and used in the following manner. The variable output nozzle 10 or 86 except for the spherical ball 20 would be machined from a suitable material such as steel or stainless steel in a manner well known in the art. It is of course important that bore 14 diameter be sufficiently close to the diameter of the spherical ball 20 so that there is little or no fluid leakage around the ball 20 when the ball 20 is in the bore 14 below the slot bottoms, such as the bottoms 66, 68, 70, and 72. However, at the same time the spherical ball 20 must be readily movable in the bore 14. The spherical ball 20 itself should in the preferred embodiment be made from a gem such as a sapphire or a ruby although in certain cases a stainless steel ball 20 might be satisfactory.

The conduit 26 would then be inserted into the hole 22 in the housing 12 and connected to the conduits 82, 84, 80, orifice 76, conduit 78 and constant pressure source 74 in the previously described manner and as illustrated in FIG. 2. Fluid such as air or a gas then flows through the conduit 78, orifice 76, and conduits 80, 82 and 84. The fluid that flows through the conduit 82 enters the bore 14 via the conduit 26. This fluid pushes up on the spherical ball 20. At the same time a downward force F is applied on the spherical ball 20 by means of an electromagnet and plunger or the like in a manner known to those skilled in the art. The force F will vary as the electrical signal is varied and when the force F is suitably varied, the fluid pressure in the bore 14 behind the ball 20 will force the ball 20 upward past the slot bottoms 66 and 68 to allow air or a gas to pass from the bore 14 into the lower portions 42 and 44 of the slots 34 and 36. This of course will result in a drop in pressure in the transducer output conduit 84. As the electrical signal is varied to reduce the force F further, the ball 20 will move upward past the slot bottoms 70 and 72 to allow air or a gas to pass from the bore 14 into the lower portions 46 and 48 of the slots 70 and 72 and this will result in a further drop in pressure in the transducer output conduit 84. In view of the operation of the variable output nozzle 10 or 86, the pressure in the output conduit 84 will be substantially proportional to the electrical signal that varies the force F.

Although the variable output nozzles 10 and 86 have been described as pneumatic pressure transducer nozzles, it will be appreciated that these nozzles 10 and 86 may have other uses.

Although the invention has been described in considerable detail with reference to certain preferred embodiments, it will be understood that variations or modifications may be made within the spirit and scope of the invention as defined in the appended claims.

What is claimed is:

1. A variable output pneumatic nozzle for use with air or a gas comprising a nozzle housing having a circular cross sectional bore located therein, reciprocating means located within the bore of said nozzle housing for reciprocal movement within said bore, said reciprocating means comprising a substantially spherical shaped ball, means connected to the bore of said nozzle housing for supplying air or gas to the bore of said nozzle housing to act upon said substantially spherical shaped ball and air or gas releasing means for varying the volume of air or gas exiting said nozzle housing when said substantially spherical shaped ball is located at predetermined locations within the bore of said nozzle housing, said air or gas releasing means comprising a plurality of slots extending through said nozzle housing and into said bore with the longitudinal axes thereof located substantially parallel to the path of travel of said reciprocating ball, said slots each having a slot bottom located to allow air or a gas to pass from said bore into at least a portion of said slots when said ball moves past the bottom of said slots with the bottom of at least one of said slots being located at a different depth than the bottom of another slot and force exerting means to act upon said substantially spherical shaped ball in a direction opposite the action of the air or gas in said nozzle housing.

2. The variable output pneumatic nozzle of claim 1 wherein the diameter of the bore of said housing is sized to provide little or no air or gas leakage around said substantially spherical shaped ball when said substantially spherical shaped ball is in the portion of said bore having no slot portions.

3. The variable output pneumatic nozzle of claim 2 wherein the slot bottoms of at least some of said slots are substantially flat.

4. The variable output pneumatic nozzle of claim 2 wherein the slot bottoms of at least some of said slots are tapered.

5. The variable output pneumatic nozzle of claim 2 wherein at least some of said slots are located substantially directly opposite said bore from another slot.

6. The variable output pneumatic nozzle of claim 4 wherein the tapered slot bottoms form substantially V shaped bottoms.

7. The variable output pneumatic nozzle of claim 5 further comprising a conduit having a portion thereof received by said nozzle housing and wherein said conduit prevents said substantially spherical shaped ball from passing out of one end of said bore.

8. The variable output pneumatic nozzle of claim 5 wherein the portion of said nozzle housing with said slots has a flared shaped opening extending from said bore to the end surface of said nozzle housing.

9. The variable output pneumatic nozzle of claim 8 wherein said flared shaped opening is funnel shaped.

10. The variable output pneumatic nozzle of claim 8 wherein said nozzle housing has threads on a portion of its exterior surface.

11. The variable output pneumatic nozzle of claim 10 wherein said substantially spherical shaped ball comprises a gem.

12. The variable output pneumatic nozzle of claim 11 wherein said gem comprises a sapphire.

13. The variable output pneumatic nozzle of claim 12 wherein said sapphire comprises a ruby.

14. The variable output pneumatic nozzle of claim 13 wherein a portion of the exterior of said housing is hexagonal shaped.

15. The variable output pneumatic nozzle of claim 1 wherein the distance between the bottom of one slot located at a different depth than the slot bottom of another slot of said plurality of slots is about 0.001 of an inch to about 0.030 of an inch.

* * * * *